US009961961B2

(12) United States Patent
Smith

(10) Patent No.: US 9,961,961 B2
(45) Date of Patent: May 8, 2018

(54) FOOTBED WITH CORK FOOT-CONTACTING SURFACE

(71) Applicant: NIKE, Inc., Beaverton, OR (US)

(72) Inventor: Mark Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 53 days.

(21) Appl. No.: 14/843,034

(22) Filed: Sep. 2, 2015

(65) Prior Publication Data

US 2017/0055639 A1 Mar. 2, 2017

(51) Int. Cl.

| | |
|---|---|
| ***A43B 13/18*** | (2006.01) |
| ***A43B 3/26*** | (2006.01) |
| ***A43B 17/00*** | (2006.01) |
| ***A43B 1/06*** | (2006.01) |
| ***A43B 13/08*** | (2006.01) |

(52) U.S. Cl.

CPC ..... *A43B 17/006* (2013.01); *A43B 1/06* (2013.01); *A43B 13/08* (2013.01); *A43B 17/00* (2013.01)

(58) Field of Classification Search

CPC ..... A43B 17/00; A43B 17/006; A43B 1/06; A43B 17/12; A43B 13/08; A43B 13/026

See application file for complete search history.

(56) References Cited

U.S. PATENT DOCUMENTS

| | | | | | |
|---|---|---|---|---|---|
| 909,138 | A | | 1/1909 | Belonga | |
| 1,491,086 | A | * | 4/1924 | Dessau | A43B 3/101 36/11.5 |
| 1,591,018 | A | * | 7/1926 | Cutler | C08L 97/007 12/146 BR |
| 1,978,549 | A | * | 10/1934 | Muir | A43B 1/06 156/279 |
| 2,117,183 | A | * | 5/1938 | Lumbard | A43B 13/40 36/19 R |
| 2,224,590 | A | * | 12/1940 | Boivin | A43B 7/06 36/3 B |
| 2,410,019 | A | * | 10/1946 | Davis | A43B 13/37 36/28 |
| 2,469,372 | A | * | 5/1949 | Cuthill | A43B 13/223 260/998.13 |
| 3,110,615 | A | * | 11/1963 | Keel | C08G 18/4054 427/392 |

(Continued)

FOREIGN PATENT DOCUMENTS

| | | | |
|---|---|---|---|
| CA | 1267352 | A | 4/1990 |
| DE | 29910281 | U1 | 8/1999 |
| WO | 2007143228 | A2 | 12/2007 |

OTHER PUBLICATIONS

International Search Report and Written Opinion dated Nov. 10, 2016 in International Patent Application No. PCT/US2016/055080, 14 pages.

(Continued)

*Primary Examiner* — Jila M Mohandesi

(74) *Attorney, Agent, or Firm* — Shook, Hardy & Bacon L.L.P.

(57) ABSTRACT

A footbed having a cork foot-contacting surface for use in footwear is provided. The foot-contacting surface includes portions that are altered in thickness in order to form a network of channels that cross the foot-contacting surface of the footbed. The channels facilitate dryness, reduced foot slippage within the footwear, and provide a comfortable fit.

19 Claims, 6 Drawing Sheets

(56) References Cited

U.S. PATENT DOCUMENTS

| | | | | | |
|---|---|---|---|---|---|
| 4,300,294 | A * | 11/1981 | Riecken | A43B 3/24 | 36/101 |
| 4,627,179 | A * | 12/1986 | McElroy | A43B 17/14 | 36/154 |
| 4,685,224 | A * | 8/1987 | Anger | A43B 17/08 | 36/3 B |
| 5,553,399 | A | 9/1996 | Strong | | |
| 5,896,680 | A * | 4/1999 | Kim | A43B 13/187 | 36/28 |
| 5,930,916 | A * | 8/1999 | Connor | A43B 1/06 | 36/11.5 |
| 6,003,246 | A * | 12/1999 | Pan | A43B 5/08 | 36/11.5 |
| 6,014,821 | A * | 1/2000 | Yaw | A43B 3/108 | 36/11.5 |
| 6,675,501 | B2 * | 1/2004 | Pfander | A43B 7/144 | 36/141 |
| 6,735,885 | B2 * | 5/2004 | Yaw | A43B 3/108 | 36/11.5 |
| 7,765,719 | B2 | 8/2010 | Nurse et al. | | |
| 8,051,582 | B2 | 11/2011 | Nurse et al. | | |
| 8,291,616 | B2 | 10/2012 | DiGangi | | |
| 8,671,590 | B2 | 3/2014 | Rasmussen et al. | | |
| 8,776,396 | B2 * | 7/2014 | Huynh | A43B 3/108 | 36/11.5 |
| 9,538,814 | B2 * | 1/2017 | DelCielo | A43B 13/08 | |
| 2005/0262727 | A1 * | 12/2005 | Cheng | A43B 1/0045 | 36/11.5 |

OTHER PUBLICATIONS

Olukai.com, Ohana Lace-Up Kohana, 5 pages, available Sep. 9, 2014 at: http://www.olukai.com/shop/mens/shoes/ohana-lace-up-kohana.

* cited by examiner

FOOTBED WITH CORK FOOT-CONTACTING SURFACE

CROSS-REFERENCE TO RELATED APPLICATIONS

Not applicable.

TECHNICAL FIELD

Aspects of a concept provided herein relate to a footbed for footwear. More specifically, the aspects relate to a footbed having a cork-based foot-contacting surface effective to absorb moisture and reduce slippage.

BACKGROUND

Athletes generally rely on a footwear's footbed to provide some stabilization of the foot. For example, an athlete may wear a shoe having a footbed that is designed to prevent slippage of the foot within the shoe during sports play. The footbed may be in the form of an insole (e.g., sockliner), midsole, or outsole and it may also function as a strobel element in some instances.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects hereof are directed toward a footbed having a cork or cork-based foot-contacting surface that reduces foot slippage within a shoe and absorbs or wicks moisture away from the foot. A footbed forms the foot-contacting surface of an article of footwear. In exemplary aspects, the footbed may be in the form of an insole (e.g., sockliner), midsole, or outsole and may also function as a strobel element.

As provided herein, a sockliner is an exemplary footbed. Generally, a sockliner is a protective layer of a shoe inserted above a cushioning midsole (e.g., with respect to a ground contacting surface of footwear) so as to form the footbed of footwear and contact the foot of a wearer. The sockliner includes a lower surface that may be affixed or glued to a strobel element or midsole, in some aspects. Opposite the lower surface, the sockliner includes an upper surface for generally contacting a user's foot as placed into a shoe. The upper surface of a sockliner component may be referred to as a foot-contacting surface. While a user may include one or more articles on their foot, such as a sock, the foot-contacting surface serves as the interface between the article of footwear and the user's foot as presented (e.g., with or without a sock). The upper surface may be ergonomically contoured to cradle a user's foot. One or more layers of various materials may be interspersed between the lower surface and the upper surface of the sockliner, thus providing additional support, structure, and comfort to a user's foot during wear.

In aspects, an upper surface of a footbed (i.e., the foot-contacting surface) comprises a layer of cork, cork sheet, or other cork-based material. The thickness of the cork may vary. Generally, cork and cork-based materials are flexible, soft, and yielding, thus providing a comfortable cushion for a foot placed within or into a shoe. Cork is also elastic or "bouncy" such that it absorbs shock and re-expands quickly after compression (e.g., resilient). These characteristics lend cork and cork-based materials to incorporation with a foot-contacting or upper surface of a footbed. Cork and cork-based materials have been utilized in the manufacturing of footwear for some time (e.g., U.S. Pat. No. 909,138 to G. W. Belonga).

The characteristics of cork and cork-based materials described above may be further enhanced and exploited as will be described regarding the footbed described herein. The cellular structure of cork itself is, generally, impermeable to liquids (e.g., water) and thus resists water and dampness, for instance. This impermeable quality gives cork antimicrobial properties, as well. As such, the moisture-resistant quality of the cork footbed may be exploited for direct contact with a user's foot (e.g., with or without an intervening sock) during wear (e.g., footbed is not fabric-covered or flocked). But unlike natural cork, the exposed surface area of the cork-covered foot-contacting surface provided herein may be increased using any number of artificial reduction, subtraction methods, or alternatively, addition methods that create and form additional surfaces or faces (e.g., channels) upon the foot-contacting surface. These artificially-produced additional surfaces are larger in magnitude and more robust than the natural variances and pitting found on a cork sheet. As the number of surfaces increases, the surface area increases and thus the rate of evaporation of moisture is increased. This produces an exceptionally dry footbed that surpasses the basic properties of plain, natural cork sheet. Second, the additional surface area that is intentionally created using manufacturing techniques also enhances grip of the foot within the footwear, as contacting the footbed. Thus, while natural variances of the cork structure itself may provide natural degree of traction, the artificial enhancements of additional surface area discussed herein produce substantially greater grip of the user's foot when in contact with the cork footbed. In this way, intentionally controlled manipulation of the cork-based foot-contacting surface provide for a superior footbed. Further, the manufacturing process that produces the additional surfaces may result in some portions of the footbed having different cork properties. For example, unlike naturally occurring cork, the carbon molecule composition is reduced with provided manufacturing techniques and non-carbon content is deposited on some portions of the cork footbed as a result of forming the additional surfaces. The changed carbon composition and the deposits may alter the properties of the cork of those portions. For example, rigidity or flexibility of lower-carbon content portions may be affected. In another example, in contrast to naturally occurring cork, the concentration of cork cells in a given surface area and/or volume is artificially increased for some portions of the cork footbed as a result of forming the additional surfaces. However, portions having a higher concentration of cork cells may have altered cork properties than portions having lower concentrations of cork cells. For example, compression and re-expansion properties of a portion may be affected by breakdown of a cork cell wall(s) where the numbers (e.g., concentration) of cork cells in the portion have been artificially increased.

For example, a golfer assumes his or her preferred stance (e.g., address or setup) when preparing to tee off. Beginning with the backswing, the golfer pulls the club back from the tee and up, preparing for the downswing by bringing his or her weight to the back foot. During the downswing, the golfer shifts his or her weight from the back foot to the front foot, bringing down the club until it makes contact with the golf ball. After contact or "impact," the golfer continues the swing into the follow-through or "finish." Throughout the entire swing, the golfer's weight shifts from one foot to another, based on the movement and/or twisting of the hips, torso, shoulder, and arms. Depending on the height of the golfer, the club used (e.g., weight, length, and flexibility), and the power and momentum of the swing, a significant amount of force is exerted during the swing which affects the placement of the foot within a shoe. Thus, an increased surface area of the footbed reduces moisture and increases traction of a foot in contact with the cork footbed in order to promote stabilization of a user's foot as well as comfort.

In another example, when a football player plants his or her shoe into the turf in preparation for cutting to evade a defending midfielder, or for setting up a goal shot, the foot within the shoe should only experience a negligible and safe amount of movement that promotes comfort during rigorous play. A surface of a footbed may contribute to lessening or reducing said amounts of movement of the foot within the shoe by increasing surface area and gripping the foot within the shoe. Thus, the football player's foot is stabilized, allowing him or her to finish a maneuver without destabilizing or compromising joints, ligaments, tendons, and/or muscles (e.g., knee, Anterior Cruciate Ligament (ACL), and Achilles tendon). Too much slippage of the foot within the shoe may lead to sprained ligaments or strained muscles. As such, the increased surface area of an upper surface of a footbed and the impermeable qualities of cork or cork-based materials placed thereon promote stabilization and dryness.

BRIEF DESCRIPTION OF THE DRAWINGS

The present invention is described in detail herein with reference to the attached drawing figures, wherein.

DETAILED DESCRIPTION

The subject matter of aspects of the present invention is described with specificity herein to meet statutory requirements. But the description itself is not intended to necessarily limit the scope of claims. Rather, the claimed subject matter might be embodied or carried out in other ways to include different elements or combinations of elements similar to the ones described in this document, in conjunction with other present or future technologies.

While the examples of a footbed are presented in a simplified fashion for exemplary purposes herein, in practice a footbed may comprise a large number of individual parts or layers, often formed from different types of materials. Alternatively, a footbed may be primarily formed from a single manufacturing technique to concurrently and integrally form two or more portions of the footbed. The components of a footbed may be joined together using a variety of adhesives, stitches, and other types of joining/bonding components. As such, the footbed may include any number of layers of various materials, each layer imbuing the footbed with characteristics for structure, foot support, and/or comfort. While these and other components that may be present in a footbed are not specifically described in examples herein, such components may be present in articles of footwear manufactured using systems and methods in accordance with aspects hereof.

Figure 6:
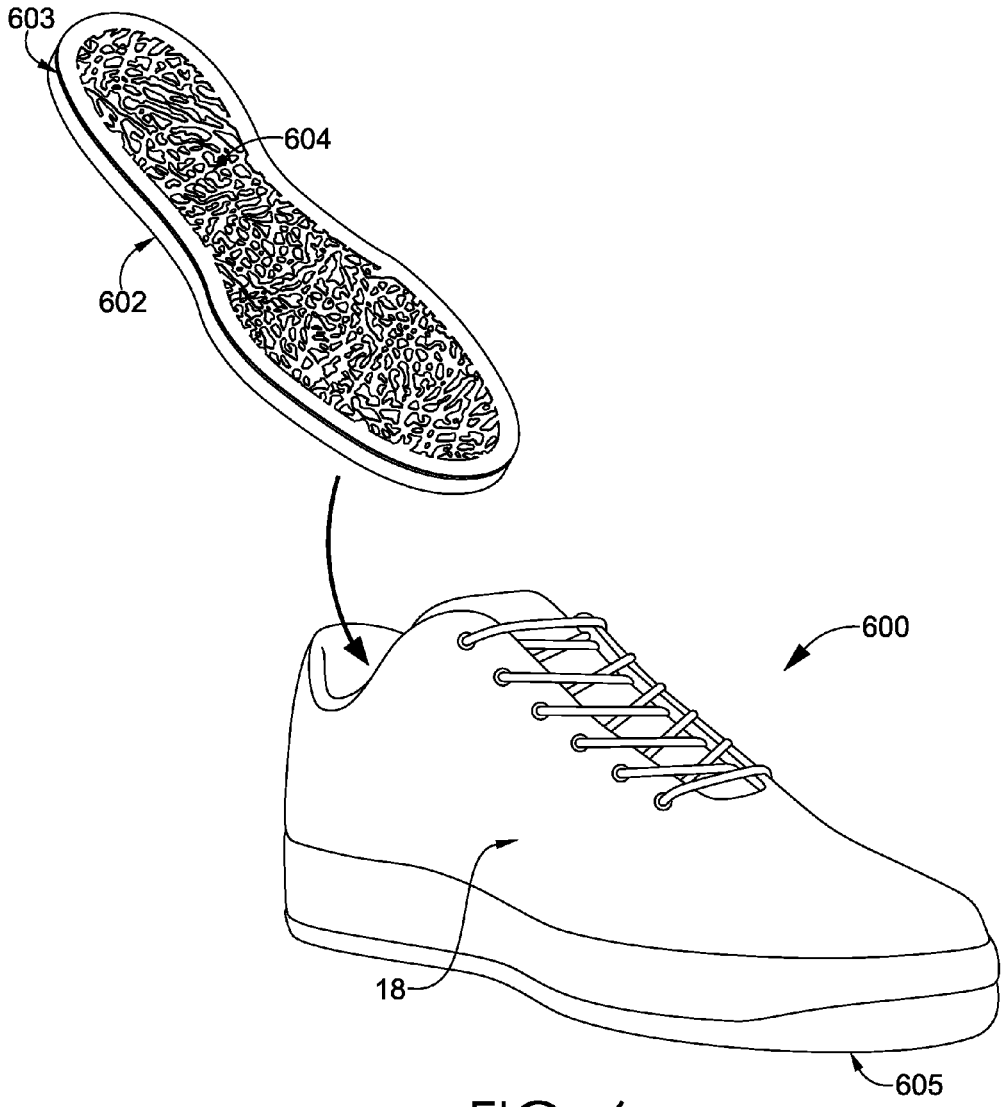
FIG. 6 depicts a perspective of an article of footwear having a cork footbed in accordance with an aspect hereof.
Figure 7:
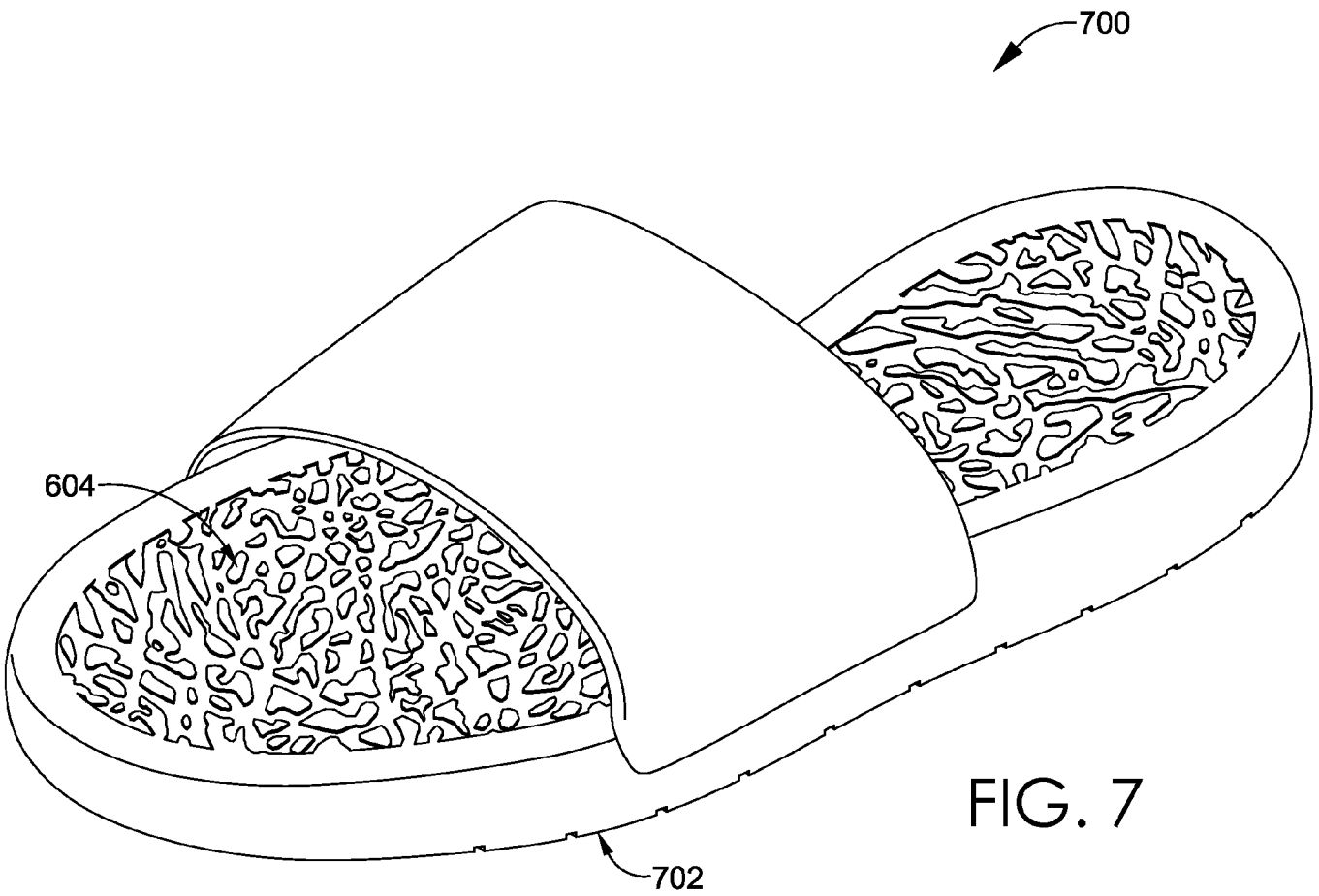
FIG. 7 depicts a perspective of an article of footwear having a cork footbed in accordance with an aspect hereof.

A footbed may be formed as a unitary sole component such that a bottom surface of the footbed serves as an outsole surface and an opposite top surface serves as a foot-contacting surface, as generally depicted in FIG. 7 hereinafter. A footbed may also be formed as a midsole component such that a bottom surface of the footbed contacts one or more components of the footwear, such as a top surface of an outsole that is opposite a ground-contacting surface of the outsole, as generally depicted in FIG. 6 hereinafter. In this example, the top surface of the footbed is a foot-contacting surface. Further yet, a footbed may also be formed as a sockliner or insole component that has a bottom surface that is configured to contact one or more components of the article of footwear, such as a strobel portion and/or a midsole component. In this example, the top surface of the footbed is a foot-contacting surface. Therefore, it is contemplated that a footbed may form one or more components of an article of footwear that extend between a wearer's foot and a ground surface.

Figure 1:
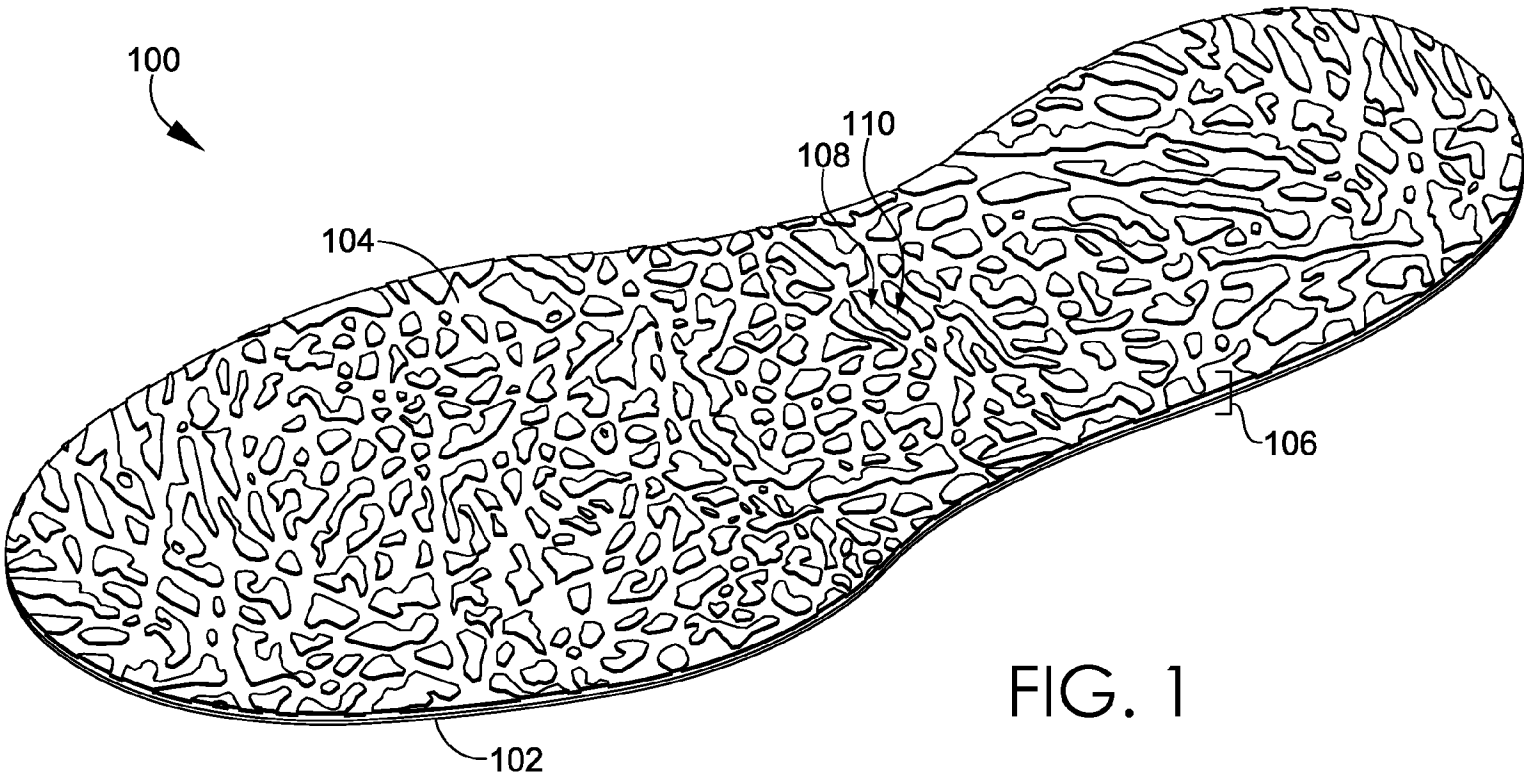
FIG. 1 depicts a footbed having a cork-based surface in accordance with an aspect hereof.

Referring now to FIG. 1, an exemplary footbed 100 having a cork-based surface is depicted in accordance with an aspect hereof. As illustrated in exemplary FIG. 1, the footbed 100 is shown as a sockliner-like structure prior to insertion into the footwear or after it has been removed from an article of footwear. However, as provided herein, the illustration of a sockliner-like structure, a midsole insert structure, or as a unitary sole structure is exemplary in nature and not limiting as the footbed is contemplated as being inclusive of the various examples. The footbed 100 of FIG. 1 is shown alone for discussion purposes only, and it is understood that other forms of footbed may be implemented in various foot wear iterations. It will be apparent to one practicing in the art that the footbed 100 is just one component of many that are assembled together to form a finished shoe or article of footwear. Exemplary types of footwear that employ the footbed 100 described here include running shoes, golfing shoes, wrestling shoes, sandals, and the like.

The footbed 100 includes a lower surface 102 and an opposite upper surface 104. In one aspect, the lower surface 102 may be placed on top of or above, with respect to a ground-contacting surface (e.g., outsole), a midsole component and/or a strobel component in a final assembled shoe or article of footwear. In a further aspect, the lower surface 102 may include a strobel component used to secure a perimeter of the footbed 100 to an upper. In another aspect, the lower surface 102 may include a midsole component having cushioning characteristics such that the lower surface may abut a surface of a strobel layer/element, for example. In further aspects, the lower surface 102 may include or be integrated with a strobel component, and/or a midsole component. In yet another aspect, the footbed 100 may form a portion of a unitary sole component, wherein the unitary sole component comprises and/or provides a function of each of a footbed 100, a strobel component, a midsole component, and an outsole component, in a final shoe or article of footwear. The described components are understood to be non-limiting in nature such that additional components not described herein may be included. Further, the described components are understood to be non-restricting such that the components described herein may not be required in various footwear aspects, and no dependency between, organization, or sequence of the described components is implied.

In one unitary sole component aspect, such as will be discussed with respect to FIG. 7, the lower surface 102 may form an outsole surface configured for contacting the ground when worn, and further, the lower surface 102 may be molded to include traction elements. In another unitary sole component aspect, the unitary sole component may also function as a strobel component, where a perimeter of the unitary sole component may be bonded and/or stitched to a footwear upper, for example. It will be understood by those in the art that the description of various footwear components (e.g., strobel, midsole, and/or outsole) should not be construed to be limiting and/or required, as various embodiments of exemplary footwear may include multiple separate and distinct components that may be affixed and/or otherwise bound to one another. Further, it will be understood that the exemplary unitary sole component may be integrally formed so as to perform the function of one or more footwear components, and/or any combination thereof. Any number and/or combination of components are considered to be within the scope of this description.

Continuing, the lower surface 102 may be glued, adhered, or otherwise affixed to another footwear component such as a midsole, a strobel, or an outsole. Generally, the lower surface 102 is offset from the upper surface 104 by the body 106 of the footbed 100, and/or other integrated footwear components, in some aspects.

The body 106 comprises the structure of the footbed 100, including the lower surface 102, the upper surface 104 and everything in between. Accordingly, the body further includes both the lower surface 102 and the upper surface 104, as offset from the lower surface 102, in aspects. The body 106 of the footbed 100 may comprise one or more layers of materials that provide structure to the footbed 100, support for a user's foot during wear, and/or a substrate to which materials may be affixed. The body 106, therefore, has a thickness that creates an edge along the perimeter of the footbed 100, in aspects. The edge may generally be continuous and abut the lower surface 102 and the upper surface 104, opposite. The edge may be smooth, straight, curved, concave, convex, sloped, and/or textured. The edge of the body 106 includes a lateral edge, a medial edge, a toe edge, and a heel edge, based on customary footwear positions. The lateral edge is located such that it corresponds with the lateral region of a user's foot as placed in the shoe. The medial edge is located such that it corresponds with the medial region of a user's foot as placed in the shoe. The toe edge is located such that it corresponds with the toe region of a user's foot as placed in the shoe. The heel edge is located such that it corresponds with the heel region of a user's foot as placed in the shoe. The lateral edge, medial edge, toe edge, and heel edge together form the perimeter of the footbed 100. Further, the perimeter of the footbed 100, in the depicted example of FIG. 1, corresponds to the overall shape of the shoe (e.g., an outline of the shoe "footprint").

Opposite the lower surface 102 of the body 106 is the upper surface 104 of the body 106. Generally, the upper surface 104 is a foot-contacting surface. The upper surface 104 may be configured to directly contact a user's foot or to indirectly contact a user's foot when worn with an article of clothing such as a sock. The upper surface 104 comprises a layer of cork, cork sheet, or a cork-based material. As such, the body 106 includes the layer of cork of the upper surface 104. As explained, cork and cork-based materials are flexible, soft, and yielding. This provides a comfortable cushioning effect for a user's foot contacting the upper surface 104. The resilient ability to compress and quickly re-expand assists with absorbing shock during wear, as well. The impervious nature of cork also resists moisture and imbues the upper surface 104 with antimicrobial properties.

The cork comprises all or substantially all of the upper surface 104, in aspects. The cork may be affixed to a substrate and comprise a portion of the body of the footbed 100, thereby forming the upper surface 104 itself. The cork of the upper surface 104, as shown, includes portions having a first thickness and portions having a second thickness. In aspects, portions having a first thickness may be referred to as first-thickness portions 108 and portions having a second thickness may be referred to as second-thickness portions 110. In other aspects, portions having a greater thickness may be referred to as "A" portions and portions having a lesser thickness may be referred to as "B" portions. Thickness is generally measured from or otherwise relative to the lower surface 102 such that a distance from the lower surface 102 to an upper surface 104 of a given portion may be described as thickness. Thickness may further describe or refer to the relief of the upper surface 104 formed by the difference in thickness of a plurality of portions, in some aspects. However, thickness may be relative to the body of the footbed 100 or relative between first-thickness portions 108 and second-thickness portions 110. Measurement from the lower surface 102 is used merely for simplicity herein and, as such, should not be considered limiting. Additionally, use of the terms "first" and "second" are not meant to denote any degree of thickness (e.g., greater or lesser thickness) or any particular manufacturing order or sequence but rather are used for clarity throughout the Description. Each of the first thickness and the second thickness may include a negligible range of thicknesses caused by the natural surface of cork materials, wherein the range is negligible when compared to the difference between the first thickness and the second thickness. Generally, the difference between the first thickness and the second thickness is an intentional deviation in thickness in addition to natural thickness variances that may be found in cork. Further, throughout this Description, portions having a first thickness may be also be described as first-thickness portions 108 and portions having a second thickness may also be described as second-thickness portions 110, for clarity and simplicity.

In some aspects, the second thickness is less than the first thickness. The second thickness is a result of manufacture and does not refer to any thickness variations caused by the naturally occurring surface of the cork. As such, the first thickness refers to a distance from the lower surface 102 to the naturally occurring surface of the cork (e.g., cork sheet, cork-based material) as it forms at least a portion of the upper surface 104. And, the second thickness refers to a distance from the lower surface 102 to the manufactured variations of the upper surface 104. The portions having the second thickness, in this example, form channels or canals that traverse the upper surface 104. The channels generally traverse the upper surface 104 such that portions of the upper surface 104 having a first thickness are surrounded or bounded by said channels. The channels may be configured in any number of ways, as will be described hereinafter. Notably, the channels are not naturally occurring and do not correspond to the natural surface variations or pitting found in cork-based materials. Rather, channels are intentionally and artificially produced.

Figure 2:
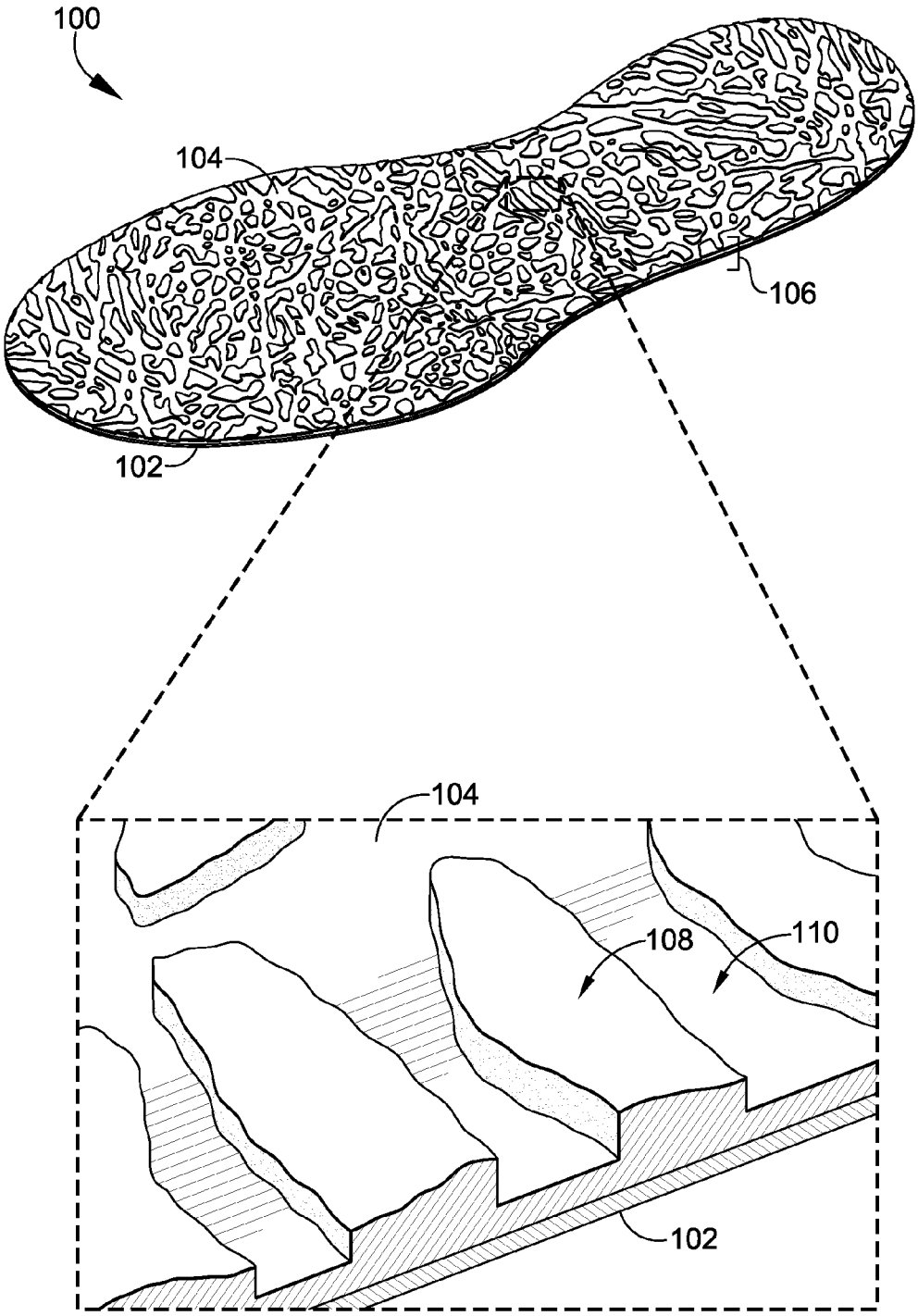
FIG. 2 depicts a perspective detail view of a footbed having a cork-based surface in accordance with an aspect hereof.

FIG. 2 depicts a perspective cross sectional detail view of the footbed 100 having a cork-based surface of FIG. 1, in accordance with an aspect hereof. The upper surface 104 is a cork or cork-based material that is bonded to or affixed to a substrate of the body 106 of the footbed 100, as shown in this exemplary aspect. The ratio of the layer of cork relative to a substrate layer may vary depending on the materials used. In aspects, a substrate and/or the body 106 may comprise several layers and various materials to which cork may be affixed (e.g., mesh) to form the upper surface 104.

The perspective view of a cross section detail depicts the first thickness and the second thickness of the upper surface 104 in relief. In exemplary FIG. 2, the second thickness is less than the first thickness when measured from the lower surface 102. Alternatively, the second thickness might be greater than the first thickness. Generally, the difference between the first thickness and the second thickness increases the surface area of the upper surface 104, which promotes evaporation of moisture from the upper surface 104. As recessed, the surfaces of second-thickness portions 110 are offset from the surfaces of first-thickness portions 108. For simplicity, the upper surface 104 will be considered to include both surfaces of second-thickness portions 110 and first-thickness portions 108. Accordingly, the surface area of the upper surface 104 includes, at least, surfaces of second-thickness portions 110 and surfaces of first-thickness portions 108. In further aspects, the upper surface 104 includes any surfaces created by the offset of first-thickness portions 108 from second-thickness portions 110. The offset may be perpendicular or substantially perpendicular to the lower surface 102, in some aspects. The offset might be straight, sloped, concave, convex, irregularly-shaped or angled, in further aspects. The offset may also be used to describe the difference between the first thickness and the second thickness, in aspects.

The difference between the first thickness and second thickness may also be described as a depth of channels forming a network covering the upper surface 104, in aspects. This difference or depth is equal to the offset between first-thickness portions 108 and second-thickness portions 110, generally. In various aspects, the offset may be measured in millimeters (mm) and found to be within a range of 0.5 mm to 4 mm. The intentional offset of 0.5 mm to 4 mm provides greater surface area and a stronger grip of a foot in contact therewith than the natural surface variances of cork. This offset may be contrasted with the natural surface variances found in cork materials that may be measured in microns, for example. The channels formed by the difference in thickness allow air to circulate underneath a user's foot, as contacting the upper surface 104. The difference in thickness, the depth of channels, or the offset may bear a relationship to the width of said channels. Width, for example, may describe a measurement from a first point on a perimeter of a first-thickness portion 108 across the upper surface 104 of the same first-thickness portion 108 to an opposite second point on the perimeter of the same first-thickness portion 108. Further, the difference in thickness, the depth of channels, or the offset may be proportional to a surface area of individual first-thickness portions 108, as bounded by one or more channels. For example, the widths of channels may be less relative to the widths of surfaces of individual first-thickness portions 108, overall or in average. As such, channels would appear narrow compared to the first-thickness portions 108 which the channels surround or otherwise form the boundaries thereof. Alternatively, the width of channels may be such that the widths of channels are similar to the widths of surfaces of individual portions having a first thickness, overall or in average. In aspects, the width of channels is equal to or greater than the depth of channels. Alternatively, in aspects, the width of the channels is less than the depth of the channels. Various combinations of width and depth of the channels, as well as the surface areas of individual portions having a first thickness, may be considered within the scope of this disclosure. In further aspects, the upper surface 104 might include portions having a third thickness. A third thickness may be intermediate such that it is less than the first thickness but more than the second thickness, in such aspects. Alternatively, the third thickness may be less than the second thickness.

As illustrated, second-thickness portions 110 of the upper surface 104 resemble or form channels that traverse the upper surface 104 to form a network of channels (e.g., second-thickness portions) that cross and/or cover all or substantially the entire upper surface 104. The second-thickness portions 110 and/or channels may surround and/or bound first-thickness portions 108 of the upper surface 104. As such, the first-thickness portions 108 resemble or form "plateaus" of the upper surface 104. The first-thickness portions 108 may be interspaced, regularly or randomly, by the network formed by the intersection of second-thickness portions 110 or channels across the upper surface 104. In some aspects, the second-thickness portions 110 form an irregularly shaped (e.g., random, abstract, or asymmetrical) network of channels that traverse or cross the upper surface 104. Alternatively, the network may be regularly shaped to form a symmetrical, geometric, and/or repeating pattern across the upper surface 104.

The second-thickness portions 110 may cover the upper surface 104 such that second-thickness portions 110 comprise half or more than half of the upper surface 104. Alternatively, the second-thickness portions 110 may traverse the upper surface 104 such that second-thickness portions 110 comprise less than half of the upper surface 104. In further aspects, the second-thickness portions 110 may traverse the upper surface 104 such that second-thickness portions 110 comprise one fourth or less of the upper surface 104. Additional ratios (e.g., one-eighth, one-sixteenth, etc.) of the second-thickness portions 110 relative to or compared to the first-thickness portions 108 are contemplated to be encompassed by this Description. The ratio of second-thickness portions 110 forming the upper surface 104, in comparison to first-thickness portions 108 forming the upper surface 104, may affect the ability of the upper surface 104 to grip a foot in contact therewith by promoting or increasing contact of the upper surface 104 with the foot, and thus preventing slippage. Further, the ratio of second-thickness portions 110 forming the upper surface 104 may affect the comfort of a wearer by promoting more contact with the first-thickness portions 108. For example, a higher the ratio of first-thickness portions 108 comprising the upper surface 104 may result in greater foot contact with first-thickness portions 108 relative to second-thickness portions 110. As such, the dimensions (e.g., width and length as parallel to the upper surface 104 and/or depth as perpendicular to the upper surface 104) of the recessed second-thickness portions 110 forming the channels may bear a relationship to surface areas of neighboring individual first-thickness portions 108, an aggregated surface area of first-thickness portions 108, and/or the entire surface area of the upper surface 104. Additionally, second-thickness portions 110 may have the same or similar widths and/or offsets. For example, all or most of the second-thickness portions 110 may have a same or a similar offset from the first-thickness portions 108. In another example, the width of all or most of the second-thickness portions 110 may be the same or similar.

In some aspects, the network formed by the second-thickness portions 110 may include channels that run from one edge of the body 106 to another edge of the body 106. For example, the second-thickness portions 110 may cross the upper surface 104 from the lateral edge to one or more of a medial edge, a toe edge, and a heel edge, as shown in illustrative FIG. 1. In an alternative aspect, the network formed by the second-thickness portions 110 may include channels that run from one region of the upper surface 104 to another region of the upper surface 104, without meeting a medial edge, a toe edge, and a heel edge, as shown in exemplary FIG. 5. For example, in FIG. 5, the second-thickness portions 110 may cross the upper surface 104 from a lateral region to one or more of a medial region, a toe region, a heel region, or a combination thereof, such that the medial edge, the toe edge, the heel edge and the lateral edge each consist of first-thickness portions 108. In further examples, the second-thickness portions 110 and the network formed thereof correspond to areas of the upper surface 104 that receive the greatest amount of foot-contact and/or downward pressure during wear by a user (e.g., may correspond to a bare foot footprint).

The network formed by the second-thickness portions 110 may be uniform in distribution across the upper surface 104. Alternatively, the network formed by the second-thickness portions 110 may be non-uniform. For example, more second-thickness portions 110 or channels may traverse one or more of a lateral region and a medial region than a toe region and a heel region. As such, the network may have a higher concentration of second-thickness portions 110 (e.g., a greater number of second-thickness portions) or channels at or near a lateral region, a medial region, a toe region, a heel region, or a combination thereof. For example, the second-thickness portions 110 or channels traversing the upper surface 104 (e.g., foot-contacting surface) are placed such that there is a greater concentration (e.g., a great number of channels) of second-thickness portions 110 or channels located at or near the toe region and/or the heel region than the medial region and/or the lateral region. In another example, the second-thickness portions 110 or channels traversing the upper surface 104 (e.g., foot-contacting surface) are placed such that there is a greater concentration of second-thickness portions 110 or channels at or near the medial region and/or the lateral region than at the toe region and/or the heel region. Generally, the network of channels covers or traverses all or substantially all of the upper surface 104 (e.g., foot-contacting surface).

In further aspects, methods are provided for manufacturing and forming the footbed 100 described herein. For example, the footbed 100 is molded into a particular shape and contour using pressure and/or temperature to change the shape and contour of the footbed 100. A particular shape and contour may generally refer to an orthotic-based configuration that contours or complements the surface of a user's foot, for example, to cradle a user's foot when a shoe is worn. The footbed 100 may be hot molded or cold molded depending on the materials used and desired outcomes for the footbed 100, for example. After molding the footbed 100 into a particular shape and contour, in further aspects, the upper surface 104 of the footbed 100, in an exemplary aspect, is laser etched so as to create the second thickness. The laser etching, being a reductive or subtractive process, is to be performed after molding in order to avoid damage or tearing of the cork of the footbed 100 resulting from pressure used in the molding process combined with reduced thickness of the layer of cork, in aspects. It will be understood that other reductive techniques (e.g., branding, scoring, cutting, milling, etching, embossing, molding, and the like) may be used to create portions having a second thickness (e.g., second-thickness portions 110), and the description herein in not to be construed as limiting. Further, it is contemplated that a sequence of steps may be altered in the construction/forming of the footbed 100 (e.g., a reductive technique applied before a molding/shaping technique is applied). Depending on the construction, the footbed 100 may be removable so that it may be replaced when worn or damaged. In other aspects, the footbed 100 is not removable so that its position within the shoe is fixed and permanent.

Additionally, depending on the molding, etching, embossing or like technique employed, the upper surface 104 comprising second-thickness portions 110 may have a different composition or different properties than the upper surface 104 comprising first-thickness portions 108. For example, when laser etching or another thermal-produced reductive technique is employed, the upper surface 104 comprising second-thickness portions 110 may have lower carbon molecule content (e.g., fewer carbon molecules) than the upper surface 104 comprising first-thickness portions 108. Due to the application of extreme heat which causes the vaporization of the cork, carbon molecules in the cork are converted into and released, at least in part, as carbon dioxide. Other molecules (e.g., minerals) of the cork are left behind to form a deposit upon the upper surface 104 comprising second-thickness portions 110. The first-thickness portions 108 may lack such deposits in a comparable concentration and may have a higher carbon molecule concentration or content than the heat-treated second-thickness portions 110. In another example, when pressure-produced reductive techniques are utilized to form second-thickness portions 110, such as embossing, the second-thickness portions 110 may include a higher cork-cell concentration at the upper surface 104 than first-thickness portions 108. Additionally, the pressure-treated second-thickness portions 110 may exhibit different properties than the first-thickness portions 108 because the cellular structure of the cork cells have been altered. In yet another example, when pressure-produced reductive techniques are utilized to form second-thickness portions 110, the second-thickness portions 110 may include a higher cork-cell density at the upper surface 104 relative to cork-cell density than first-thickness portions 108. As used herein, cork-cell density refers to the material density of the cork and cork-cells themselves as they comprise the upper surface 104. If compressed, the cork cells may be made dense such that they occupy less space than prior to compression, for example.

Figure 3:
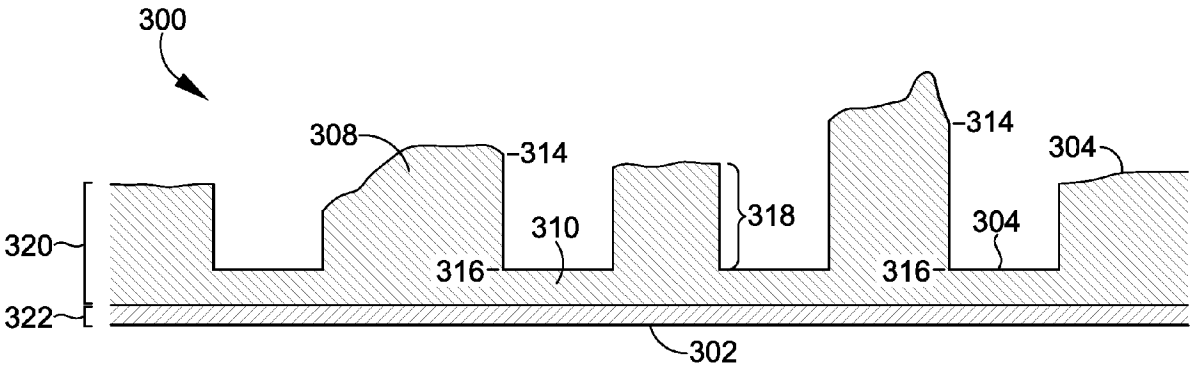
FIG. 3 depicts a cross section of a footbed having a cork-based surface in accordance with an aspect hereof.

In exemplary FIG. 3, an exemplary cross section of a footbed 300 having a cork-based surface is shown, in accordance with an aspect hereof, is illustrated. The footbed 300 depicted in FIG. 3 may be similar to the exemplary footbed 100 of FIG. 1. As shown, a layer of cork 320 has been affixed or otherwise adhered to a substrate 322. The elements depicted in FIG. 3 may be equivalent to similar elements depicted in FIG. 1. For example, the first-thickness portions 308 of FIG. 3 may be equivalent to the first-thickness portions 108 of FIG. 1. Together, the layer of cork 320 and the substrate 322 form the body 306 of the footbed 300. The layer of cork 320 forms an upper surface 304 for contacting a user's foot, while the substrate 322 forms the lower surface 302. The proportion of cork to substrate may vary, and the depiction of FIG. 3 is not to be construed as limiting in this regard. Additionally, although the substrate 322 and layer of cork 320 appear planar, they may be shaped or molded so as to contour to a user's foot, and as such, FIG. 3 is not to be construed as limiting.

First-thickness portions 308 are bounded by neighboring second-thickness portions 310. As depicted in the aspect of exemplary FIG. 3, the first thickness 314 may include natural thickness variances of the layer of cork 320. The first thickness 314 of one or more first-thickness portions 308 may generally be determined or measured where a first-thickness portion abuts, meets, or is otherwise adjacent to a second-thickness portion. Additionally, the first thickness 314 of one or more first-thickness portions 308 may be determined or measured from the lower surface 302 to a point where the one or more first-thickness portions 308 abut, meet, or are otherwise adjacent to a second-thickness portion 310. In some aspects, the first thickness 314 may be determined or measured from the lower surface 302 to the greatest relief of a first-thickness portion 308. As measured from the lower surface 302, the difference 318 between the first thickness 314 and the second thickness 316 may be the same or similar, or alternatively, varied based on natural thickness variances of the layer of cork 320. The second thickness 316 may generally be determined or measured where a second-thickness portion 310 abuts, meets, or is otherwise adjacent to a first-thickness portion 308. In some aspects, the second thickness 316 may be determined or measured from the lower surface 302 to the greatest relief of a second-thickness portion 310. Any natural variance in thickness of the layer of cork may generally be negligible in relation to the difference 318 of the first thickness 314 and the second thickness 316. As shown, the second thickness 316 may be uniform or substantially uniform, whereas the first thickness 314 includes negligible natural variances of the cork. Any range of thickness of the first thickness 314 is generally negligible and/or less than the difference 318 between the first thickness 314 and the second thickness 316. Generally, the difference 318 between the first thickness 314 and the second thickness 316, or the offset, may be greater than a width of second-thickness portions 310. In further aspects, the difference 318 between the first thickness 314 and the second thickness 316, or the offset, may be the same or similar to a width of second-thickness portions 310.

Figure 4:
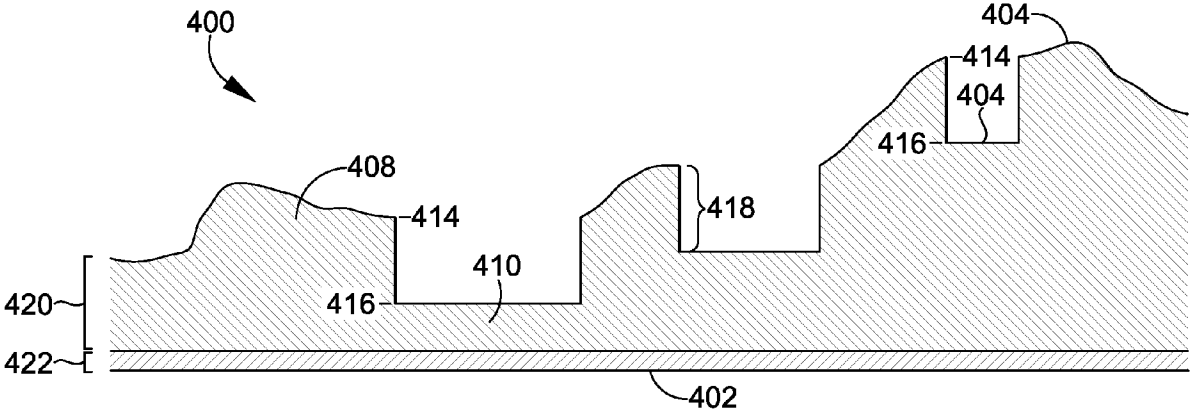
FIG. 4 depicts a cross section of a footbed having a cork-based surface in accordance with an aspect hereof.

FIG. 4 depicts another exemplary cross section of a footbed 400 having a cork-based surface in an aspect hereof. The footbed 400 depicted in FIG. 4 may be similar to the exemplary footbed 100 of illustrative FIG. 1. Additionally, the elements depicted in FIG. 4 may be equivalent to similar elements depicted in FIG. 1. For example, the first-thickness portions 408 of FIG. 4 may be equivalent to the first-thickness portions 108 of FIG. 1. And, similar to FIG. 3, the first thickness 414 of the footbed 400 as measured from the upper surface 404 to the lower surface 402 to include, in this example, the substrate 422 may include any natural thickness variances of the layer of cork 420. In FIG. 4, however, the difference 418 between the first thickness 414 and the second thickness 416 may generally be determined or measured where a first-thickness portion 408 abuts, meets, or is otherwise adjacent to a second-thickness portion 410. As such, the difference 418 between the first thickness 414 and the second thickness 416 may be measured or determined from the surfaces of first-thickness portions 408 to surfaces of second-thickness portions 410. In some aspects, the difference 418 between the first thickness 414 and the second thickness 416 may be the same or similar, such that the difference 418 remains uniform or substantially uniform as measured from the upper surface of first-thickness portions 408.

Figure 5:
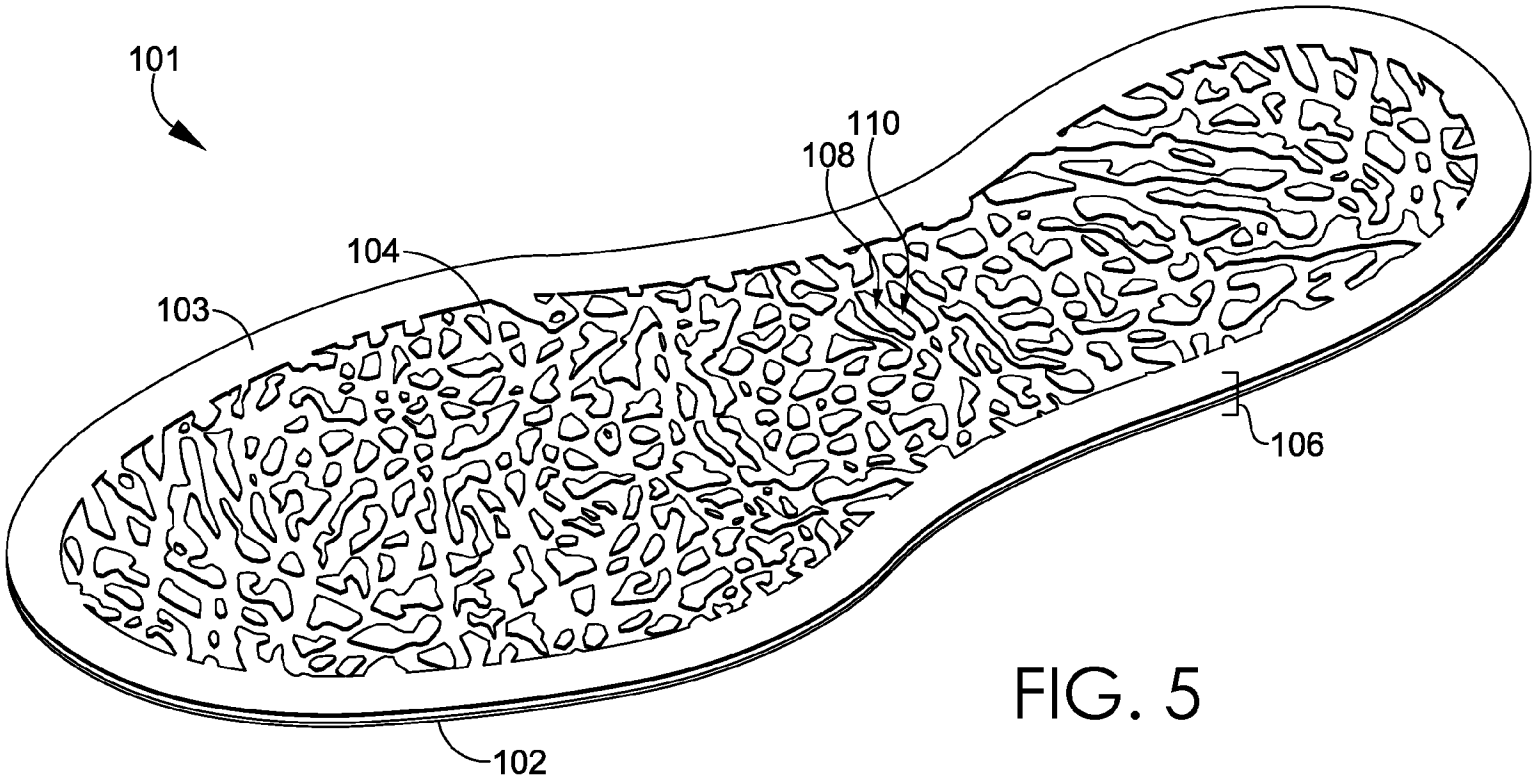
FIG. 5 depicts a footbed having a cork-based surface in accordance with an aspect hereof.

FIG. 5 depicts a footbed 101 having a cork-based surface in accordance with an aspect hereof. The footbed 101 of FIG. 5 is different from the footbed 100 of FIG. 1; however, the similarly, numbered elements may be similarly defined or otherwise equivalent to those provided in connection with FIG. 1. As such, the footbed 101 includes the upper surface 104 and the lower surface 102 with the body 106 comprising the structure there between. The footbed 101 includes first-thickness portions 108 and second-thickness portions 110 which are placed or located at the upper surface 104. In FIG. 5, a network is formed by second-thickness portions 110 which may include channels that run from one region of the upper surface 104 to another region of the upper surface 104, without meeting a medial edge, a toe edge, and a heel edge. Exemplary first-thickness portion 103, in the depicted configuration, forms a peripheral border around the footbed 101 at the upper surface 104. Further exemplary aspects of first-thickness portions 108 and second-thickness portions 110 have been previously described herein with respect to FIGS. 1 through 4. As such, it is contemplated that a perimeter band may be formed in the upper surface 104 having a first-thickness portion 108. Stated differently, the second-thickness portions 110 does not extend to the medial, lateral, toe, and/or heel ends of the footbed 101, in the illustrated example.

FIG. 6 depicts a perspective view of an exemplary article of footwear 600 having an insertable (or secured) footbed 603 having a cork upper surface 604, in accordance with aspects hereof. The footbed 603 includes a lower surface 602 that may be formed from a first material and the upper surface 604 formed from a cork-based material that is the same or different from the first material. In aspects, the footbed 603 is integrated with a midsole having cushioning characteristics such that the footbed 603 is a single or unitary component as depicted having a cork-material on the upper surface 604 and a midsole-forming material on the lower surface 602. As such, when placed within an upper 18, the lower surface 602 may abut a strobel element coupled with the upper 18 that becomes positioned between an outsole 605 and the lower surface 602. The described components are understood to be non-limiting in nature such that additional components not described herein may be included. Further, the described components are understood to be non-restricting such that the components described herein may not be required in various footwear aspects, and no dependency between, organization, or sequence of the described components is implied.

FIG. 7 depicts a perspective view of an exemplary article of footwear 700 having a unitary sole component with a lower surface 702 that may form an outsole surface configured for contacting the ground when worn and an upper surface 604 formed with a cork-based material, in accordance with aspects hereof. It is contemplated that the upper surface 604 that serves as a foot-contacting surface and is formed from a cork-based material with a first-thickness portion and a second-thickness portion may be a different material than the lower surface 702. For example, the lower surface 702 may be formed from foam, rubber, leather, or other materials suitable for forming a ground contacting surface. Therefore, the unitary sole component may be formed from multiple materials in multiple layers as a unitary construction (e.g., with adhesives, mechanical fasteners, stitching, and the like). An outsole region and midsole region of the unitary sole may be formed from a common material or different materials. Further, the lower surface 602 may be molded or formed to include traction elements. Traction elements may also be adhered or otherwise affixed to the lower surface 702, in exemplary aspects. Regardless, the upper surface 604 serves as a foot-contacting surface formed with a cork material having at least two height portions, in an exemplary aspect. It will be understood by those in the art that the description of various footwear components (e.g., strobel, midsole, and/or outsole) should not be construed to be limiting and/or required, as various embodiments of exemplary footwear may include multiple separate and distinct components that may be affixed and/or otherwise bound to one another, as is reinforced by illustration of a sandal-like article of footwear in FIG. 7. Further, it will be understood that the exemplary unitary sole component may be integrally formed so as to perform the function of one or more footwear components, and/or any combination thereof.

Any number and/or combination of components are considered to be within the scope of this description. From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed in:

1. An article of footwear having a footbed, the footbed comprising:

a body having a lateral edge, a medial edge, a toe edge, and a heel edge, wherein the lateral edge is located opposite the medial edge and the toe edge is located opposite the heel edge, the body further having a bottom surface and a foot-contacting surface opposite the bottom surface, the foot-contacting surface comprising a layer of cork, the layer of cork comprising carbon molecules, portions of the layer of cork having a first thickness and portions of the layer of cork having a second thickness that is less than the first thickness, the first thickness and the second thickness are measured from the bottom surface of the body to the foot-contacting surface of the body, wherein the portions of the layer of cork having the second thickness surround the portions of the layer of cork having the first thickness to form a network of channels in the layer of cork at the foot-contacting surface, and wherein the portions of the layer of cork having the second thickness have fewer carbon molecules than the portions of the layer of cork having the first thickness due to an artificial creation of the second thickness.

2. The footbed of claim 1, wherein the network of channels traverse the foot-contacting surface from a toe region to a heel region and from a medial region to a lateral region.

3. The footbed of claim 2, wherein the network of channels traverse the foot-contacting surface across the toe region, the heel region, the medial region, and the lateral region.

4. The footbed of claim 2, wherein the layer of cork has a greater number of portions of cork having the second thickness located at the toe region and the heel region of the foot-contacting surface than the medial region and the lateral region.

5. The footbed of claim 2, wherein the layer of cork has a greater number of the portions of cork having the second thickness near the medial region and the lateral region than at the toe region and the heel region.

6. The footbed of claim 1, wherein the portions of cork having the second thickness form the network of channels to traverse the foot-contacting surface from the lateral edge to the medial edge and from the toe edge to the heel edge.

7. The footbed of claim 1, wherein a difference between the first thickness and the second thickness is an intentional and artificially created deviation from natural thickness variances in the layer of cork.

8. The footbed of claim 1, wherein a difference between the first thickness and the second thickness is determined from the bottom surface to the foot-contacting surface comprising portions having the first thickness and from the bottom surface to the foot-contacting surface comprising portions having the second thickness.

9. The footbed of claim 1, wherein one of the portions of the layer of cork having the first thickness includes a surface area that is twice a surface area of an adjacent portion having the second thickness.

10. The footbed of claim 9, wherein a difference between the first thickness and the second thickness is similar to a width of a portion having the second thickness.

11. A footbed for an article of footwear, the footbed comprising:

a body having a continuous perimeter formed by a lateral edge, a medial edge, a toe edge, and a heel edge, wherein the lateral edge is located opposite the medial edge and the toe edge is located opposite the heel edge, the body further having a bottom surface and a foot-contacting surface opposite the bottom surface, the foot-contacting surface comprising a layer of cork, the cork comprising plant cells, portions of the layer of cork having a first thickness and portions of the layer of cork having a second thickness that is less than the first thickness, the first thickness and the second thickness being measured from the bottom surface, wherein the portions of the layer of cork having the second thickness surround the portions of the layer of cork having the first thickness to form a network of channels in the layer of cork and traversing the foot-contacting surface, and wherein, at the foot contacting surface, the portions of the layer of cork having the second thickness have a greater density of the plant cells than the portions of the layer of cork having the first thickness due to an artificial creation of the second thickness.

12. The footbed of claim 11, wherein the network of channels traverses the foot-contacting surface from a toe region to one or more of a heel region, a medial region, a lateral region, or a combination thereof.

13. The footbed of claim 12, wherein the continuous perimeter consists of the portions having the first thickness.

14. The footbed of claim 11, wherein the portions having the second thickness that form the network of channels traversing the foot-contacting surface contact each of the lateral edge, the medial edge, the toe edge, and the heel edge of the body.

15. The footbed of claim 11, wherein the portions having the second thickness comprise one-fourth or less of the foot-contacting surface.

16. The footbed of claim 11, wherein each of the portions having the second thickness have a similar offset from the portions having the first thickness.

17. The footbed of claim 11, wherein each of the portions having the second thickness has a similar width.

18. The footbed of claim 11, wherein the portions having the second thickness have a greater number of the plant cells at the foot-contacting surface than the portions having the first thickness as the foot-contacting surface.

19. A footbed for an article of footwear, the footbed comprising:

a body having a perimeter formed by a lateral edge, a medial edge, a toe edge, and a heel edge, wherein the lateral edge is located opposite the medial edge and the toe edge is located opposite the heel edge, the body further having a bottom surface and a foot-contacting surface opposite the bottom surface, the foot-contacting surface comprising cork, the cork comprising carbon molecules, portions of the cork having a first thickness and portions of the layer of cork having a second thickness, the first thickness and the second thickness being measured from the bottom surface of the body, the first thickness being at least one millimeter greater than the second thickness, and wherein the portions of cork having the second thickness form a network of channels that surround the portions of cork having the first thickness to traverse the foot-contacting surface, the portions of cork having the first thickness comprising at least two-thirds of the foot-contacting surface, and wherein the portions of cork having the second thickness comprise fewer carbon molecules than the portions of cork having the first thickness due to an artificial creation of the second thickness.

* * * * *